US006858168B1

(12) United States Patent
Vollrath et al.

(10) Patent No.: US 6,858,168 B1
(45) Date of Patent: Feb. 22, 2005

(54) APPARATUS AND METHOD FOR FORMING MATERIALS

(75) Inventors: Friedrich Wilhelm Ludwig Paul Vollrath, Oxford (GB); David Philip Knight, Winchester (GB)

(73) Assignee: Spin'Tech Engineering GmbH, Fellbach (DE)

( * ) Notice: Subject to any disclaimer, the term of this patent is extended or adjusted under 35 U.S.C. 154(b) by 288 days.

(21) Appl. No.: 10/148,101

(22) PCT Filed: Nov. 24, 2000

(86) PCT No.: PCT/GB00/04489

§ 371 (c)(1),
(2), (4) Date: May 22, 2002

(87) PCT Pub. No.: WO01/38614

PCT Pub. Date: May 31, 2001

(30) Foreign Application Priority Data

Nov. 27, 1999 (GB) ..... 9927950

(51) Int. Cl.[7] ..... D01D 4/02; D01D 5/06; D01D 5/247; D01F 4/00

(52) U.S. Cl. ..... 264/41; 264/183; 264/211.12; 264/555; 425/192 S; 425/378.2; 425/382.2; 425/461; 425/463; 425/464

(58) Field of Search ..... 264/41, 183, 211.12, 264/555; 425/192 S, 378.2, 382.2, 461, 463, 464

(56) References Cited

U.S. PATENT DOCUMENTS

| | | | | |
|---|---|---|---|---|
| 2,450,457 A | | 10/1948 | Te Grotenhuis | |
| 3,832,116 A | * | 8/1974 | Delorme | 425/381.2 |
| 3,907,484 A | * | 9/1975 | Delorm et al. | 425/467 |
| 4,485,062 A | * | 11/1984 | Dawes et al. | 264/173.19 |
| 5,460,498 A | | 10/1995 | Steel et al. | |
| 5,702,527 A | | 12/1997 | Seaver et al. | |
| 5,746,966 A | | 5/1998 | McDonald | |
| 5,866,251 A | * | 2/1999 | Bastioli et al. | 428/364 |
| 6,110,590 A | | 8/2000 | Zarkoob et al. | |

FOREIGN PATENT DOCUMENTS

| | | | | |
|---|---|---|---|---|
| EP | 0 104 081 A2 | | 3/1984 | |
| EP | 0 656 433 A1 | | 6/1995 | |
| GB | 322764 A | | 12/1929 | |
| GB | 441440 A | | 1/1936 | |
| GB | 1 594 530 A | | 7/1981 | |
| JP | 06047798 A | * | 2/1994 | 264/211.12 |

OTHER PUBLICATIONS

Chen et al, Characteristics and Design Procedure of Hyperebolic Dies, Journal of Polymer Science, 1992, pp. 557–561, vol. 30.

Knight et al, Liquid Crystals And Flow Elongation In A Spider's Silk Production Line, Proc. R. Soc. Lond. 1999, pp. 519–523, vol. 266.

Vollrath et al, Silk Production In A Spider Involves Acid Bath Treatment, Proc. R, Soc. Lond. 1998, pp. 817–820, vol. 265.

* cited by examiner

*Primary Examiner*—Leo B. Tentoni
(74) *Attorney, Agent, or Firm*—Stephen H. Eland; Dann, Dorfman, Herrell and Skillman

(57) ABSTRACT

An apparatus and method for forming liquid spinning solution into a solid formed product whereby the solution is passed through at least one tubular passage (17) having walls formed at least partly of semipermeable and/or porous material. The semipermeable and/or porous material allows parameters, such as the concentration of hydrogen ions, water, salts and low molecular weight, of the liquid spinning solution to be altered as the spinning solution passes through the tubular passage(s).

24 Claims, 4 Drawing Sheets

APPARATUS AND METHOD FOR FORMING MATERIALS

TECHNICAL FIELD

This invention relates to an apparatus and method for forming spun material, such as filaments, fibres, ribbons, sheets or other solid products, from a liquid spinning solution, such as a polymer solution (which term includes a protein solution or cellulose solution).

BACKGROUND ART

There is currently considerable interest in the development of processes and apparatus to enable the manufacture of polymer filaments, fibres, ribbons or sheets. It is theoretically possible to obtain materials with high tensile strength and toughness by engineering the orientation of the polymer molecules and the way in which they interact with one another. Strong, tough filaments, fibres or ribbons are useful in their own right for the manufacture, for example, of sutures, threads, cords, ropes, wound or woven materials. They can also be incorporated into a matrix with or without other filler particles to produce tough and resilient composite materials. Sheets whether formed from fibres or ribbons can be stuck together to form tough laminated composites.

Natural silks are fine, lustrous filaments produced by the silk-worm *Bombyx mori* and other invertebrate species. They offer advantages compared with the synthetic polymers currently used for the manufacture of materials. The tensile strength and toughness of the dragline silks of certain spiders can exceed that of Kevlar™, the toughest and strongest man-made fibre. Spider dragline silks also possess high thermal stability. Many silks are also biodegradable and do not persist in the environment. They are recyclable and are produced by a highly efficient low pressure and low temperature process using only water as a solvent. The natural spinning process is remarkable in that an aqueous solution of protein is converted into a tough and highly insoluble material.

According to an article by J. Magoshi, Y. Magoshi, M. A. Becker and S. Nakamura entitled "Biospinning (Silk Fiber Formation, Multiple Spinning Mechanisms)" published in Polymeric Materials Encyclopedia, by the Chemical Rubber Company, it is reported that natural silks are produced by sophisticated spinning techniques which cannot yet be duplicated by man-made spinning technologies.

Other known processes for producing filaments from liquid raw material are disclosed in GB-A-441440 and U.S. Pat. No. 2,450,457. These known processes pass the liquid raw material through rigid porous tubes.

Fibres produced by existing technological processes and apparatus suffer from the following disadvantages. Many show "die swell" which leads to some loss of molecular orientation with a consequent degradation of mechanical properties. This is not seen in natural silks which show strongly uniaxial orientation. Furthermore, existing processes are not energy efficient, requiring high temperatures and pressures to reduce the viscosity of the feedstock so that it can be forced through a die. Separate stages are often required, for example for further "draw-down", to anneal the fibre with heat, and to process it through separate acid or alkaline treatment baths.

Disclosure of the Invention

It is an aim of the present invention to provide an improved method and apparatus for spinning a liquid spinning solution or "dope".

According to a first aspect of the invention there is provided spinning apparatus for forming spun material from a liquid spinning solution, the apparatus including a die assembly having at least one tubular passage through which the liquid spinning solution is passed having at least partly permeable walls, wherein said walls defining the or each tubular passage comprise at least one semipermeable membrane and/or at least one porous membrane. Preferably enclosure means surround the walls. The provision of enclosure means allows components of fluent material contained in the enclosure means and in contact with the walls to pass through the or each semipermeable or porous membrane. Alternatively components of the liquid spinning solution passing through the or each tubular passage may pass outwardly through the walls of the semipermeable or porous membrane. In addition, since the or each semipermeable or porous membrane is generally flexible, it will be necessary to fill the enclosure means with a pressurised fluent material to maintain the shape of the walls defining the tubular passage during passage of the spinning solution through the tubular passage.

According to a second aspect of the invention there is provided a method of forming material by passing liquid spinning solution through at least one tubular passage of a die assembly having at least partly prmeable walls, wherein the walls of the or each tubular passage comprise at least one semipermeable membrane and/or at least one porous membrane and in that the liquid spinning solution is treated, as it passes along the or each tubular passage, by components permeating through the semipermeable or porous membrane of said walls. In this way fluent material may pass inwardly into, or outwardly from, the or each tubular passage through their semipermeable or porous walls.

The discovery of the way in which spiders produce dragline silk provides the basis for the invention. We have found that by making the walls of the or each tubular passage at least partly permeable or porous, preferably selectively permeable along the length of the tubular passage, which is preferably tapered, it is possible to control properties such as the pH, water content, ionic composition and shear regime of the spinning solution in different regions of the tubular passage of the die. Ideally this enables the phase diagram of the spinning solution to be controlled allowing for pre-orientation of the fibre-forming molecules followed by a shear-induced phase separation and allowing the formation of insoluble fibres containing well-orientated fibre-forming molecules.

Conveniently the walls defining the tubular passage(s) are surrounded by said enclosure means to provide one or more compartments. These compartments act as jackets around the tubular passage(s). The or each tubular passage suitably has an inlet at one end to receive the spinning solution and an outlet at the other for the formed or extruded material and is typically divided into three parts arranged consecutively, the first part allowing for the pre-treatment and pre-orientation of the fibre-forming polymer molecules in the liquid feedstock prior to forming the material by draw down, the second region in which draw down of the "thread" takes place and which functions as a treatment and coating bath, and the third part has an outlet or opening of restricted cross-section which serves to prevent the loss of the contents of the "treatment bath" with the emerging fibre and to provide for the commencement of an optional air drawing stage.

It will be appreciated that any solution or solvent or other phase or phases surrounding the fibre in the second part of the or each tubular passage also serves to lubricate the fibre as it moves through and out of the tubular passage.

All or part of the length of each tubular passage typically has a convergent geometry typically with the diameter decreasing in a substantially hyperbolic fashion. According to G. Y. Chen, J. A. Cuculo and P. A. Tucker in an article entitled "Characteristic and Design Procedure of Hyperbolic Dies" in the Journal of Polymer Sciences: Part B: Polymer Physics, Vol 30, 557–561 in 1992, it is reported that the orientation of molecules in a fibre can be improved by using a die with a convergent hyperbolic geometry instead of the more usual parallel capillary or conical dies.

The geometry of substantially all or part of the or each tubular passage may be varied to optimise the rate of elongational flow in the spinning solution (dope) and to vary the cross-sectional shape of the formed material produced from it. The preferred substantially hyperbolic taper for part or all of the or each tubular passage maintains a slow and substantially constant elongational flow rate thus preventing unwanted disorientation of the fibre-forming molecules resulting from variation in the elongational flow rate or from premature formation of insoluble material before the dope has been appropriately preoriented. A convergent taper to the tubular passage of the die will induce elongational flow which will tend to induce a substantially axial alignment in the fibre-forming molecules, short fibres or filler particles contained in the dope by exploiting the well known principle of elongational flow. Alternatively, the principle of elongational flow through a divergent instead of convergent die can be used to induce orientation in the hoop direction that is approximately transverse to the longitudinal axis of the extruded material.

The diameter of the or each tubular passage may be varied to produce fibres of the desired diameter.

The rheology of the liquid feedstock in the tubular passage of the die is largely independent of scale enabling the size of the apparatus to be scaled up or down. The convergence of the tubular passage allows a wide range of drawing rates to be used typically ranging from 0.01 to 1000 mm $sec^{-1}$. If fibres are being extruded they may typically have a diameter of from 0.1 to 100 $\mu$m. Typically the outlet of the tubular passage has a diameter of from 1 to 100 $\mu$m with the diameter of the inlet of the tubular passage being from 25 to 150 times greater depending on the extensional flow it is desired to produce. Tubular passages with a circular cross-section are used to produce fibres with circular cross sections. Tubular passages of alternative cross-sectional shapes can be used to produce fibres, flat ribbons or sheets of extruded materials with other cross-sectional shapes.

All or part or parts of the walls of the or each tubular passage of the die assembly are constructed from or formed or moulded from selectively permeable or porous membranes, such as cellulose acetate-based membrane sheets. The membrane can be substituted with diethylaminoethyl or carboxyl or carboxymethyl groups to help maintain protein-containing dopes in a state suitable for spinning. Other examples of permeable or porous membranes are hollow-fibre membranes, such as hollow fibres constructed from polysulfone, polyethyleneoxide-polysulfone blends, silicone or polyacrylonitrile. The exclusion limit selected for the semipermeable membrane will depend on the size of the small molecular weight constituents of the dope but is typically less than 12 kDa.

All or part of the walls of the or each tubular passage can he constructed from selectively permeable or porous membranes in a number of different ways. By way of example only a selectively permeable or porous sheet can be held in place over a groove with suitable geometry cut into a piece of material to form the tubular passage. Alternatively two selectively permeable or porous membranes can be held in place on either side of a separator to construct the tubular passage. Alternatively a single sheet can be bent round to form a tubular passage. A hollow tube of selectively permeable or porous membrane material(s) can also be used to construct all or part of the tubular passage. By way of example only, a variety of methods are available to shape the tube into a die as is commonly known to a craftsman skilled in the art.

The use of selectively permeable or porous walls for substantially all or part or parts of the tubular passage(s) enables the proper control within desired limits of, for example, the concentration of fibre-forming material; solute composition; ionic composition; pH; dielectric properties; osmotic potential and other physico chemical properties of the dope within the tubular passage by applying the well-known principles of dialysis, reverse dialysis, ultrafiltration and preevaporation. Electro-osmosis can also be used to control the composition the dope within the tubular passage. It will be appreciated that a control mechanism receiving inputs relating to the product being formed, for example the diameter of the extruded product and/or the resistance countered in the tubular passage, such as during extrusion through the outlet of the tubular passage, can be used to control, for example, polymer concentration, solute composition, ionic composition, pH, dielectric properties, osmotic potential and/or other physicochemical properties of the dope within the tubular passage.

The selective permeability and/or porosity of the walls of the or each tubular passage may also allow for the diffusion through the walls of further substances into the tubular passage(s) provided that these have a molecular weight lower than the exclusion limit of the selectively permeable material from which the walls of the tubular passage(s) are constructed. By way of example only the additional substances added to the dope in this manner may include surfactants; dopants; coating agents; cross-linking agents; hardeners; and plasticisers. Larger sized aggregates can be passed through the walls of the tubular passage if it is porous rather than being simply semipermeable.

The compartments surrounding the walls of the tubular passage or passages may act as one or more treatment zones or baths for conditioning the fibre as it passes through the tubular passage(s). Additional treatment can occur after the material has exited the outlet of the tubular passage.

One or more regions of the or each tubular passage may be surrounded by one or more compartments arranged consecutively so as to act as a jacket or jackets to hold solution, solvent, gas or vapour in contact with the outer surface of the selectively permeable walls of the tubular passage(s). Typically solution, solvent, gas or vapour is circulated through the compartment or compartments. The walls of the compartment or compartments are sealed to the outer surface of the walls of the tubular passage(s) by methods that will be understood by a person skilled in the art. The compartment or compartments serve to control the chemical and physical conditions within the or each tubular passage. Thus the compartments surrounding the tubular passage(s) serve to define the correct processing conditions within the dope at any point along the tubular passage(s) In this way parameters such as the temperature; hydrostatic pressure; concentration of fibre-forming material; pH; solute; ionic composition; dielectric constant; osmolarity or other physical or chemical parameter can be controlled in different regions of the tubular passage as the dope moves down the length of the die. By way of example only, continuously graded or stepped changes in the processing environment can be obtained.

Conveniently a selectively permeable/porous membrane can he used to treat one side of a forming extrusion in a different way to the other side. This can be used, for example, to coat the extrusion or remove solvent from it asymmetrically in such a way that the extrusion can be made to curl or twist.

All or part of the draw down process may typically occur within the die rather than at the outer face of the die assembly as occurs in existing spinning apparatus. The former arrangement offers advantage over existing spinning apparatus. The distortion of molecular alignment due to die swell is avoided. The region of the die assembly after the internal commencement of the draw down taper can be used to apply coatings or treatments to the extrusion. Further, the last part of the die assembly is water lubricated by the solvent-rich phase surrounding the extrusion.

By way of example only the apparatus can be used for forming fibres from dopes containing solutions of recombinant spider silk proteins or analogues or recombinant silk worm silk proteins or analogues or mixtures of such proteins or protein analogues or regenerated silk solution from silkworm silk. When these dopes are used it is necessary to store the dope at a pH value above or below the isoelectric point of the protein to prevent the premature formation of insoluble material. It will be appreciated that other constituents may be added to the dope to keep the proteins or protein analogues in solution. These constituents may then be removed through the semipermeable and/or porous walls when the dope has reached the appropriate portion of the tubular passage in which it is desired to induce the transition from liquid dope to solid product, e.g. thread or fibre. The dope within the tubular passage can then be brought by dialysis against an appropriate acid or base or buffer solution to a pH value at or close to the pK value of one or more of the constituent proteins of the dope. Such a pH change will promote the formation of an insoluble material. A volatile base or acid or buffer can also be diffused through the walls of the or each tubular passage from a vapour phase in the surrounding compartment or jacket to adjust the pH of the dope to the desired value. Vapour phase treatment to adjust the pH can also occur after the extruded material has left the outlet of the die assembly.

The draw rate and length, wall thickness, geometry and material composition of the or each tubular passage may be varied along its length to provide different retention times and treatment conditions to optimise the process.

One or more regions of the walls defining the or each tubular passage can be made impermeable by coating their inner or outer surfaces with a suitable material to modify the internal environment in a length of the tubular passage using any coating method as will be understood by a person skilled in the art.

The inner surface of the walls of the or each tubular passage can be coated with suitable materials to reduce the friction between the walls of the tubular passage and the dope or fibre. Such a coating can also be used to induce appropriate interfacial molecular alignment at the walls of the tubular passage in lyotropic liquid crystalline polymers when these are included in the dope.

A further embodiment allows for one or more additional components to be fed to the start of the or each tubular passage via concentric openings to allow two or more different dopes to be co-extruded through the same tubular passage allowing for the formation of one or more coats or layers to the fibre or fibres.

A further embodiment utilises a dope prepared from a phase separating mixture containing two or more components which, for example, may be different proteins. The removal or addition of components through the selectively permeable and/or porous material can be used to control the phase separation process to produce droplets of one or more components typically with a diameter of 100 to 1000 nm within the bulk phase in the final extrusion. These can be used to enhance the toughness and other mechanical properties of the extrusion. The use of a convergent or divergent die conveniently induces elongational flow in the droplets to produce orientated and elongated filler particles or voids within the bulk phase. A convergent die will orientate and elongate such droplets in a direction parallel to that of the formed product whereas a divergent die will tend to orientate the droplets in hoops transverse to the direction of flow within the tubular passage. Both types of arrangement can be used to enhance the properties of the formed product. Further it will be understood that the selectively permeable or porous walls of the or each tubular passage can be used to diffuse in or out chemicals to initiate the polymerisation of filler particles.

The spinning apparatus with one or more tubular passages surrounded by a compartment or compartments to act as jackets can be constructed by one or two stage moulding or other methods known to a person skilled in the art. It will be appreciated that a moulding process can be used to create simple or complete profiles for the or each tubular passage and the outlet of the die assembly. Very small flexible lips can be formed, e.g. moulded, at the outlet to prevent the escape of the contents of the treatment bath and act as a restriction to enable an optional additional air drawing stage or wet drawing after the material has left the outlet of the die assembly should this be required. The microscopic profile of the inner surface of the lips at the outlet can be used to modify the texture of the surface coating of the extruded material.

By way of example only, the jackets and supports for the tubular passages can be constructed from two or more components formed by injection moulding or constructed in other ways as will be understood by a person skilled in the arts. It will be appreciated that this method of construction is modular and that a number of such modules can be assembled in parallel to produce simultaneously a number of fibres or other shaped products. Sheet materials can be produced by a row or rows of such modules. Such a modular arrangement allows for the use of manifolds to supply dope to the inlet of the tubular passage(s) and to supply and remove processing solvents, solutions, gases or vapours to and from the jacket or jackets surrounding the tubular passages. Additional components may be added if desired. Potential modifications to the arrangements shown will be apparent to persons skilled in the art.

Other methods of constructing spinning apparatus in which the walls of the tubular passages are substantially or partially constructed from semipermeable or porous membrane material will be known by a person skilled in the art. By way of example only these include micro-machining techniques. In addition it will be appreciated that walls of the tubular passages substantially or partially constructed from semipermeable/porous material can be incorporated into other types of spinning apparatus, such as electrospinning apparatus.

The or each tubular passage may be made self-starting and self-cleaning. It will be appreciated that blockage of spinning dies during the commercial production of extruded materials is time-consuming and costly. To overcome this difficulty, the walls of the tubular passage may be constructed from an elastic material sealed into and surrounded by two or more jackets arranged in sequence. The pressure in each of these jackets can be varied independently by methods that will be understood by a craftsman skilled in the art. Pressure changes in the jackets can be used to change the diameter of different regions of the tubular passage in a manner analogous to a peristaltic pump to pump the dope to the outlet to commence the drawing of fibres or to clear a blockage. Thus a decrease in pressure in a jacket towards the outlet end of the tubular passage will dilate the elastic walls of the tubular passage within the jacket. If the pressure is now raised in a second jacket closer to the input end of the tubular passage a region of the walls of the tubular passage running through this jacket will tend to collapse forcing the dope towards the outlet. Alternatively, the pressure in the dope fed to the tubular passage could be increased causing the diameter of the elastic tubular passage walls to increase. It will be appreciated that both methods could be used together or consecutively. With both methods the elasticity of the passage walls enables the diameter of the tubular passage to be increased reducing the resistance to flow. With both methods it is to be noted that increasing the pressure of the dope will also assist in start up and in clearing blockages in the tubular passage. It will also be appreciated by way of example only that the use of rollers such as are used in peristaltic pumps can be used as an alternative means of applying pressure to pump dope to the outlet to commence spinning or to clear a blockage.

The pressure in the sealed compartments surrounding the tubular passage(s) may be controlled to define and modify the geometry of the tubular passage to optimise pinning conditions.

If the or each tubular passage has a convergent or divergent geometry along all or part of its length, filler articles or short fibres included in the dope may be orientated as they flow through the tubular passage by exploiting the well understood principle of elongational flow. It will be understood that the substantially axial orientation of such filler particles or short fibres will be produced by a convergent tubular passage while a divergent one will produce orientation in the hoop direction, that is approximately transverse to the long axis of the extruded material. Both patterns of orientation confer additional useful properties on the fibre. It will be appreciated that a convergent or divergent geometry of all or part of the or each tubular passage will also serve to elongate and orientate small fluid droplets of an additional solvent or solution or other phase or phases or additional unpolymerised polymer or polymers present in the dope as supplied to the tubular passage or arising by a process of phase separation within the dope. The presence of elongated and well orientated narrow inclusions formed by either a convergent or divergent tubular passage can be used to confer additional useful properties to the extruded material.

It will be appreciated that the direct drawing down of a fibre or other formed product from liquid spinning solution within a region of a tubular passage greatly improves the molecular orientation in the final material avoiding the disorientation produced by die swell produced by other methods of forming the final material. It also greatly reduces the pressure required to form material compared with the extrusion of fibre from a conventional restriction die.

The present invention seeks to alleviate some or all of the problems associated with the prior art by providing reliable apparatus and method for manufacturing materials with a highly defined and typically uniaxial molecular orientation from spinning solutions. The use of permeable/porous tubing, preferably selectively permeable/porous tubing, for the construction of the walls of the tubular passage enables a precise control of all parameters of the processing environment. This enables the processing environment to be precisely defined down the length of the tubular passage. Precise control of the processing environment in the tubular passage enables the polymer concentration, molecular configuration and viscosity and other physical properties of the spinning solution to be kept at optimum values at all points along the tubular passage. The convergent geometry with cross-sectional area decreasing non-linearly and preferably hyperbolically in substantially all or the first part of the tubular passage serves to align the molecules axially before the draw down process thus improving the quality of alignment in the final formed product.

The apparatus may be arranged in such a way that two or more fibres are formed in parallel and twisted around each other or crimped or wound onto a former or coated or left uncoated as desired. The fibres can be drawn through a coating bath and subsequently through a convergent die to give rise to a "sea and island" composite material as will be understood by a person skilled in the art. One or more rows of dies or one or more dies with slit or annular openings can be used to form sheet materials.

BRIEF DESCRIPTION OF THE DRAWINGS

An embodiment of the invention will now be described, by way of example only, with particular reference to the accompanying drawings, in which.

BEST MODE FOR CARRYING OUT THE INVENTION

Figure 1:
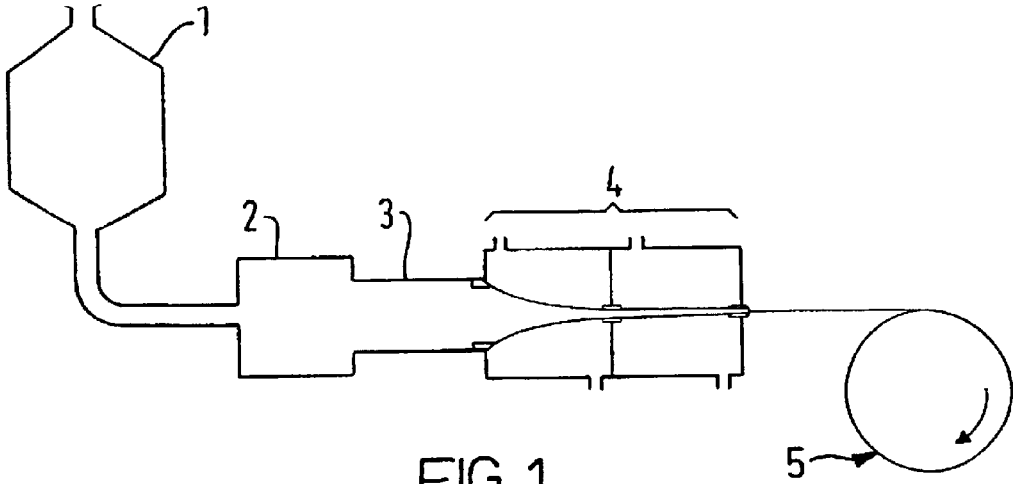
FIG. 1 is a generalised schematic representation of apparatus for the formation of extruded materials from a spinning solution.

FIG. 1 shows apparatus for the formation of extruded materials from a spinning solution such as lyotropic liquid crystalline polymer or other polymers or polymer mixtures. The apparatus comprises a dope reservoir 1; a pressure regulating valve or pump means 2 which maintains a constant output pressure under normal operating conditions; a connecting pipe 3; and a spinning die assembly 4 comprising at least one spinning tube or die further described in FIGS. 2 to 5. A take-up drum 5 of any known construction draws out and reels up extruded material at a constant tension exiting from the outlet of the die assembly 4. The pressure regulating valve or pump means 2 may be any device normally producing a constant pressure commonly known to a person skilled in the art.

The arrangement shown in FIG. 1 is purely exemplary and additional components may be added if desired. Potential modifications to the arrangement shown in FIG. 1 will be apparent to persons skilled in the art. In use dope is passed from the feedstock reservoir 1 at a constant low pressure by means of the regulating valve or pump means 2 via the connecting pipe 3 to the inlet of the spinning die assembly 4.

Figure 2:
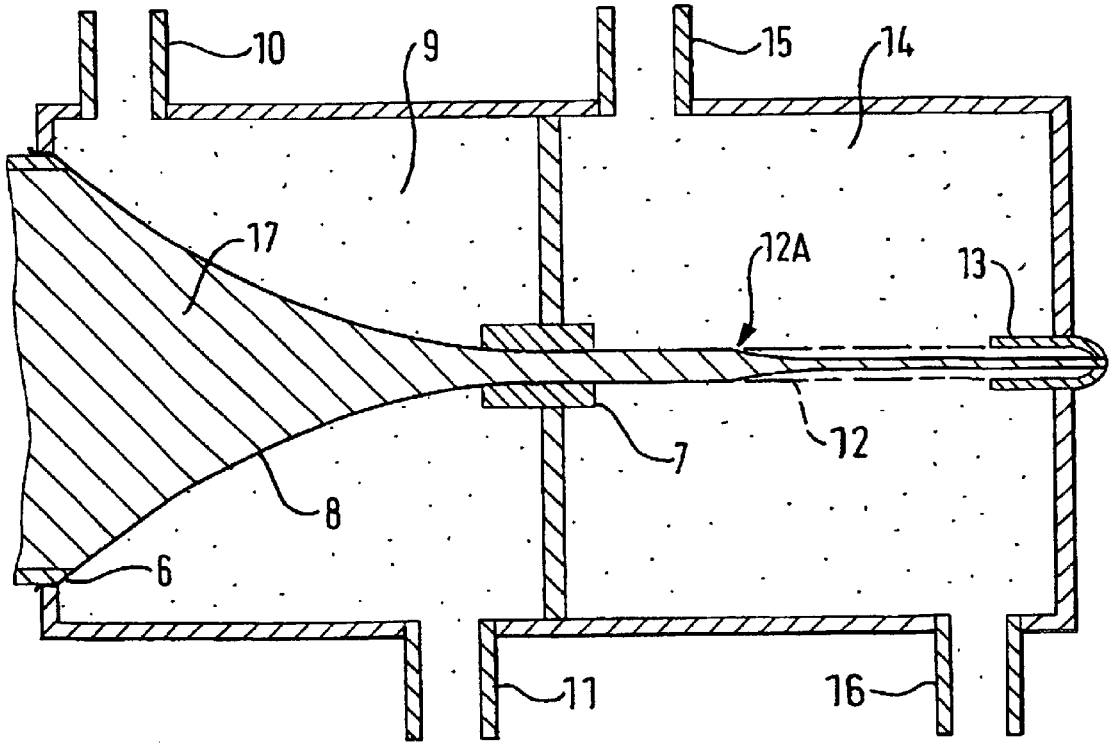
FIG. 2 is a schematic cross-sectional view along the longitudinal axis of a die assembly of the apparatus shown in FIG. 1.
Figure 3:
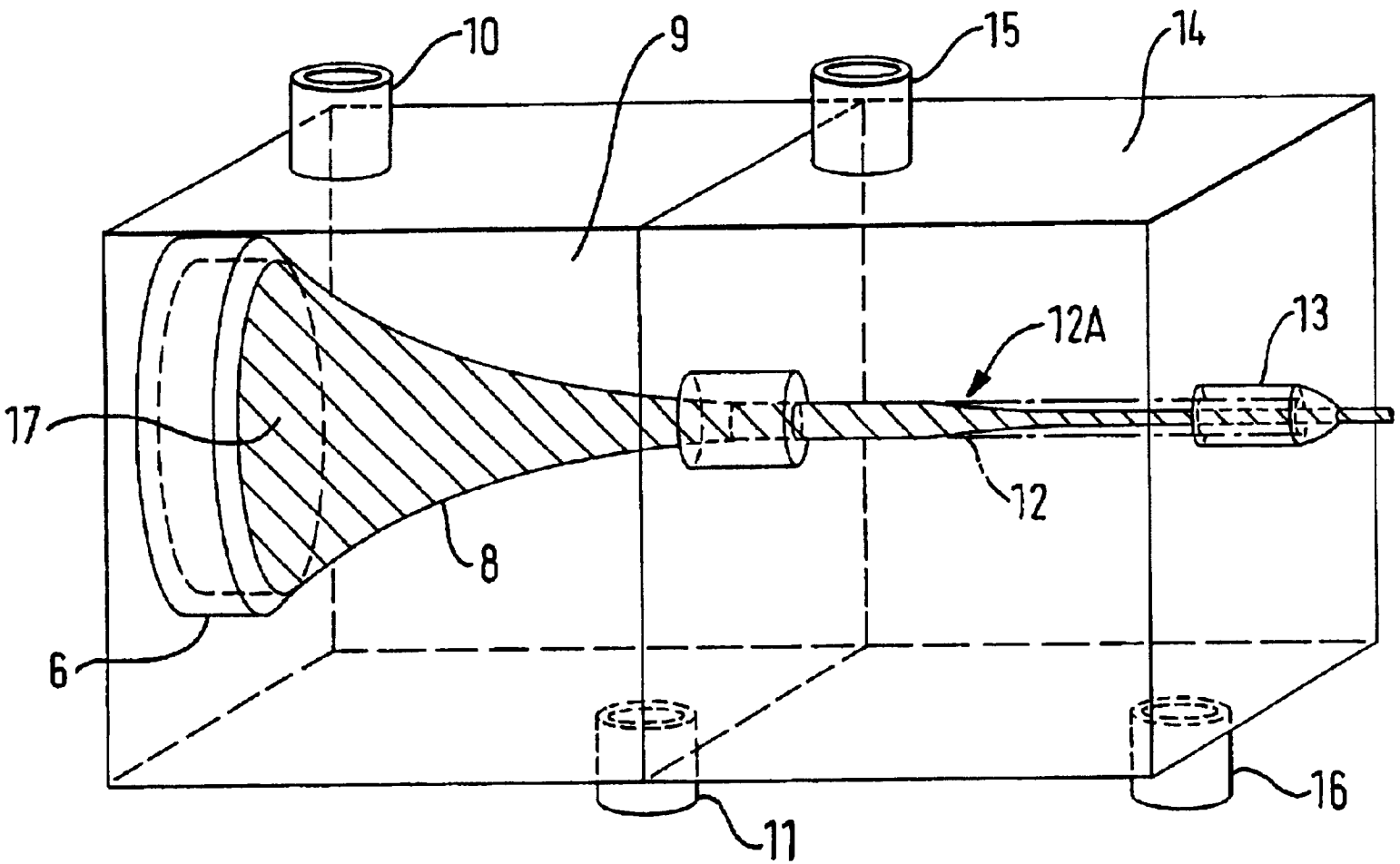
FIG. 3 is a schematic perspective view of the die assembly shown in FIG. 2.

The die assembly 4 is shown in greater detail in FIGS. 2 and 3 and comprises a first spinning tube or die 8 upstream of a second spinning tube or die 12, the dies together defining a tubular passage 17 for spinning solution through the die assembly 4. The dies 8 and 12 are made of semipermeable or porous materials, such as cellulose acetate membranes or sheets. Other examples of suitable semipermeable or porous materials are diethylaminoethyl or carboxyl or carboxymethyl groups which help to maintain protein-containing dopes in a state suitable for spinning. Hollow-fibre membranes may also be used as the semipermeable/porous membrane material, such hollow-fibre membranes being made from polysulfone, polyethyleneoxide-polysulfone blends, silicone or polyacrylonitrile. The exclusion limit selected for the semipermeable membrane will depend on the size of the small molecular weight constituents of the spinning dope but is typically less than 12 kDa.

The die 8 is held at its upstream end by a tapered adaptor 6 positioned at the inlet end of the die assembly 4 and at its downstream end by a tapered adaptor 7 positioned internally in the die assembly 4. The die 8 is held at its upstream end by the adaptor 7 and at its downstream end by a spigot 13 at the outlet of the die assembly 4. The die 8 has a convergent, preferably hyperbolic, internal passage and the geometrical taper is preferably continued with the internal passage of the die 12. This can be achieved during construction by softening a semipermeable tube or die on a warmed suitably tapered mandrel, or by other methods as will be appreciated by a craftsman skilled in the art before fitting the spinning tube or die into the apparatus. The internal passages of the dies 8 and 12 together provide the tubular passage 17 for spinning solution from the inlet to the outlet of the die assembly 4.

A jacket 9 surrounds the die 8 and is intended to contain a fluid, e.g. a solvent, solution, gas or vapour to control the processing conditions within the spinning tube or die 8. The jacket 9 is fitted with an inlet 10 and an outlet 11 to control flow of fluid into and out of the jacket. A further jacket 14 surrounds the tube or die 12 and is fitted with a fluid inlet 15 and a fluid outlet 16 to enable fluid, e.g. solvent, solution or gas, to be passed into and out of the jacket 14 in contact with the semipermeable/porous walls of the die 12.

As an alternative to the die 8 shown having semipermeable walls a die may be constructed from material which is not semipermeable but which is preferably tapered, e.g. convergently, and may be temperature-controlled by circulating fluid at a predetermined temperature through the jacket 9.

In operation spinning solution or dope, e.g. a polymer solution, is fed to the inlet of the die 8. As the dope passes along the tubular passage 17 it is treated firstly as it passes through the die 8 and secondly as it passes through the die 12. The fluid passing through the jacket 9 may merely serve to heat or maintain the dope at the correct temperature or provide the correct external pressure to the walls of the die 8. In this case it is not essential for the walls of the die to be made of semipermeable or porous material. The temperature of the dies 8 and 12 for the extrusion of protein-containing dopes should typically be maintained at a temperature of about 20° C. but spinning may be carried out at temperatures as low as 2° C. and as high as 40° C. The pressure of the fluid, liquid or gas, in the jackets surrounding the walls of the tubular passage 17 is typically maintained at a pressure close to that at which the dope is supplied to the die assembly 4. However the pressure can be somewhat higher or lower depending on the geometry of the dies and the strength of the generally flexible semipermeable/porous membrane. "Chemical" treatment of the dope occurs during "draw down"as the dope passes through the die 12 although chemical treatment may also occur as the dope passes through the die 8 if the walls of the latter are at least partly made of semipermeable material. In FIGS. 2 and 3, the abrupt pulling away of the dope from the walls of the die 12 at 12A indicates the internal draw down of the "fibre". This is a unique feature of the invention as draw down in existing processes always start at the outer opening of a die (i.e. the extrusion orifice) and not before. The pulling away of the "fibre" from the die walls at 12A occurs at a place in the tubular die 12 where the force required to produce extensional flow to create a new surface just falls below the force required to flow the dope through the die 12 in contact with the die walls. The position of 12A will depend on: the changing rheological properties of the dope; the rate and force of drawing; the surface properties of the die 12; the surface properties of the lining of the die 12; and the properties of the dope and the aqueous phase surrounding the dope.

It will be appreciated that the temperature, pH, osmotic potential, colloid osmotic potential, solute composition, ionic composition, hydrostatic pressure or other physical or chemical factors of the solution, solvent, gas or vapour supplied to the jacket(s) control or regulate the conditions inside the tubular passage 17 as is commonly understood by a craftsman skilled in the art. Chemicals in the fluid supplied to the jacket(s) are able to pass through the semipermeable or porous walls of the tubular passage to "treat" the dope passing therethrough. It is also possible for chemicals in the dope to pass outwardly through the semipermeable or porous walls of the tubular passage 17. The fluids supplied to the dope will obviously depend on the type of dope used and the semipermeable or porous membranes used. However, by way of example only, for the spinning of concentrated protein solutions, the jacket 9 may contain 100 mM Tris or PIPES buffer solution, typically at a pH of 7.4, and 400 mM sodium chloride to help maintain the folded state of the protein. The jacket 14 may contain 100 mM Tris or PIPES buffer solution at a lower pH, typically 6.3, and 250 mM potassium chloride to encourage the unfolding/refolding of the protein. High molecular weight polyethylene glycol can be added to the solution in both jackets to maintain or reduce the concentration of water in the dope.

It will be realised that the spinning tube or die 12 can be hanked or coiled or arranged in other ways between the tapered collar 7 and the spigot 13. The diameter and cross-sectional shape or the exit 13 can be varied or adjusted to suit the diameter and cross sectional shape of the formed material. For a formed product having a circular cross-section, the typical diameter of the outlet is from 1 to 100 $\mu$m and the typical diameter of the inlet to the tubular passage would be from 25 to 150 times greater than the outlet diameter depending on the extent of the extensional flow. It will be appreciated that the arrangements and proportions shown in FIG. 2 are purely exemplary and thus that additional components may be added if desired. Potential modifications to the arrangements shown in FIG. 2 will be apparent to persons skilled in the art.

Figure 4:
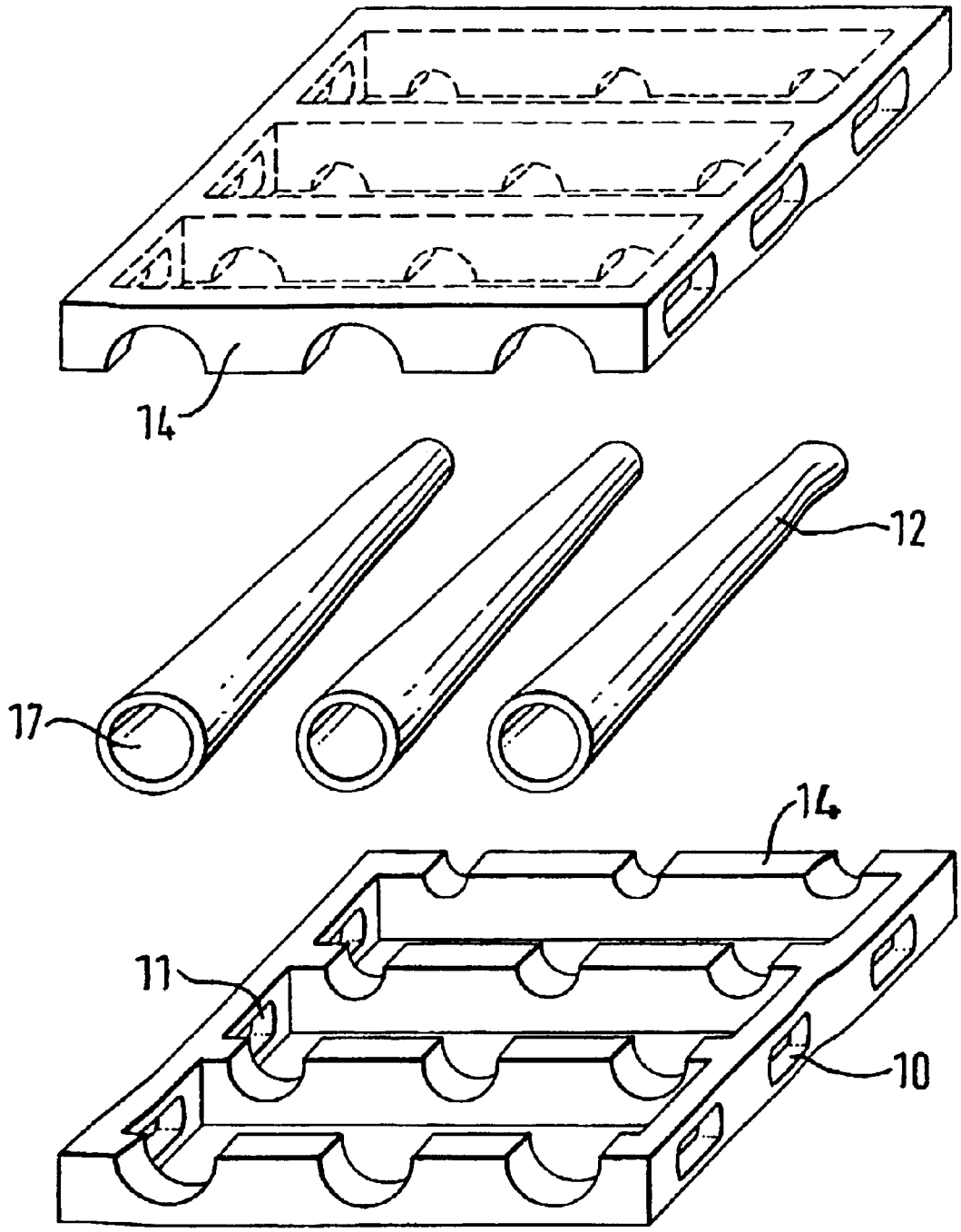
FIG. 4 is a schematic exploded view illustrating another embodiment of a die assembly of apparatus according to the invention.

FIG. 4 shows a module containing three spinning tubes or dies 12 mounted within a housing defining three "jackets" 14, the same numbering being used as in the previous embodiments to identify the same or similar parts. The arrangements and proportions shown in FIG. 2 are purely exemplary and thus additional components may be added if desired. Potential modifications to the arrangements shown in FIG. 4 will be apparent to persons skilled in the art, including the provision of fewer or more dies 12 or jackets 14.

Figure 5:
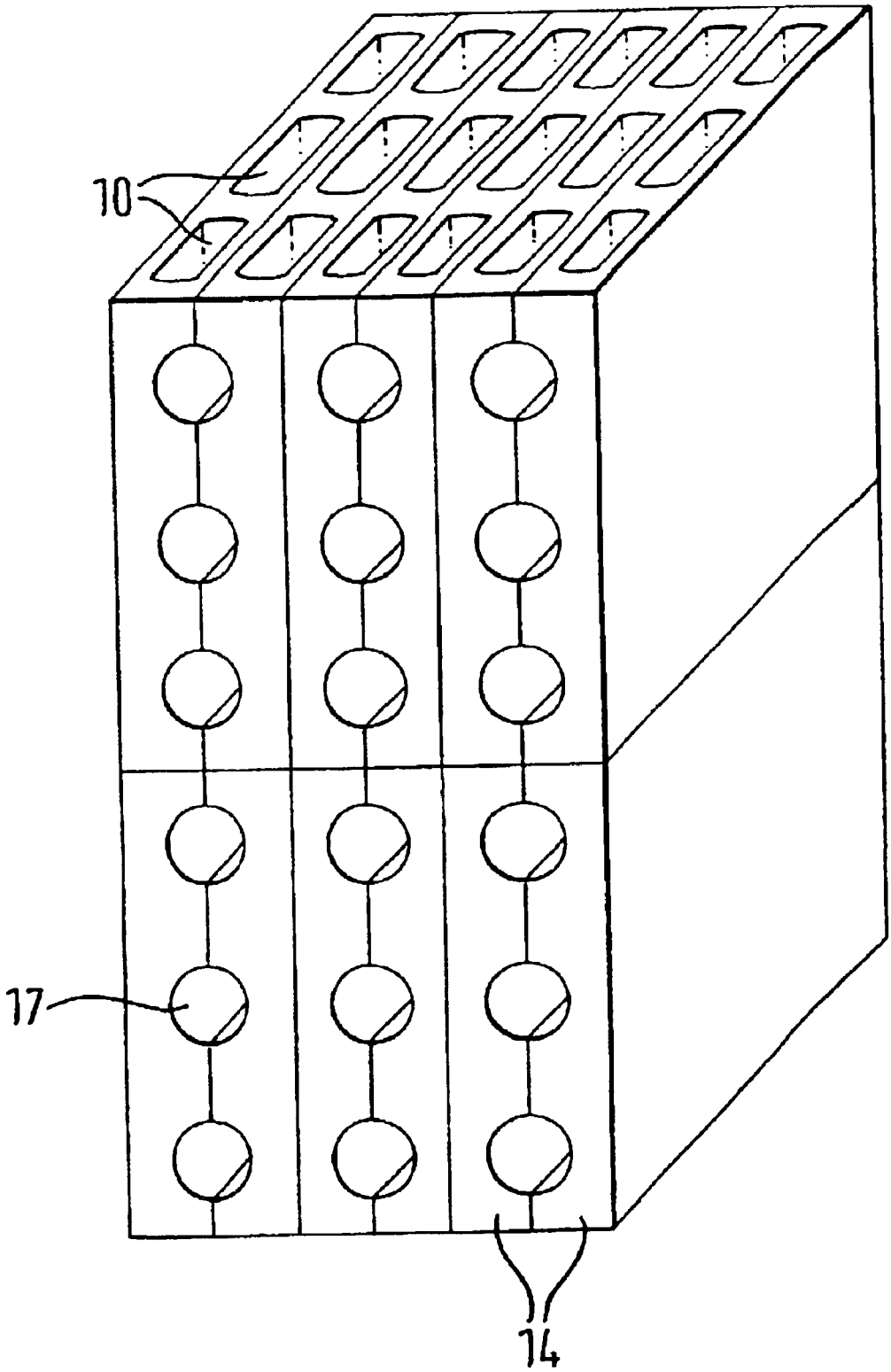
FIG. 5 is a view showing a number of die assemblies of FIG. 4 assembled together in a unit to enable a plurality of fibres to be extruded.

FIG. 5 shows how two or more modular units constructed from the apparatus shown in FIG. 4 can be held together to enable a plurality of extruded fibres to be produced. It will be appreciated that the arrangements and proportions shown in FIG. 5 are purely exemplary and thus additional components may be added if desired. Potential modifications to the arrangements shown in FIG. 5 will be apparent to persons skilled in the art.

The permeability or porosity of the walls of the tubular passage may be the same throughout the length of the latter. Alternatively, however, if the tubular passage passes through more than one treatment zone the permeability/porosity of the walls of the tubular passage may change from treatment zone to treatment zone by using different semipermeable or porous materials for the walls of the tubular passage. Thus the walls of the tubular passage may comprise: semipermeable material of the same permeability throughout the length of the passage; semipermeable material of different permeability for different portions of the passage; porous material of the same porosity throughout the length of the passage; porous material of different porosity for different portions of the passage; or semipermeable material for one or more portions of the length of the tubular passage and porous material for one or more other portions of the tubular passage. As mentioned above, some portions of the walls of the tubular passage may be non-permeable. By way of example only, suitable semipermeable materials are: cellulose derivatives, Goretex (Registered Trade Mark), polysulfone, polyethylenoxide-polysulfone blends, and silicone polyacrylonitrile blends. By way of example only, the suitable porous materials are: polyacrylate, poly (lactide-co-glycolide), porous PTFE, porous silicon, porous polyethylene, cellulose derivatives and chitosan.

It will be appreciated that the apparatus is suitable for the formation of fibres or sheets from all solutions of lyotropic liquid crystal polymers whether synthetic or man made or natural or modified or copolymer mixtures or solutions of recombinant proteins or analogues derived from them or mixtures of these. By way of example only these include collagens; certain cellulose derivatives; spidroins; fibroins; recombinant protein analogues based on spidroins or fibroins, and poly (p-phenylene terephthalates). The method is also suitable for use with other polymers or polymer mixtures provided that they are dissolved in solvents, whether aqueous or non-aqueous, protein solutions or cellulose solutions. It will also be appreciated that the use of one or more semipermeable and/or porous treatment zones can be used for dies or die assemblies having essentially annular or elongated slit openings used for the formation of sheet materials.

INDUSTRIAL APPLICABILITY

The invention has industrial application in the spinning of products.

What is claimed is:

1. Spinning apparatus for forming spun material from a liquid spinning solution, the apparatus including a die assembly having at least one tubular passage through which the liquid spinning solution is passed with at least partly permeable walls, wherein the said walls defining the at least one tubular passage comprise at least one semipermeable membrane and/or at least one porous membrane; and wherein an enclosure surrounds said walls, wherein said enclosure comprises at least two compartments isolated from each other, a first one of said at least two compartments surrounding a first portion of said walls defining an inlet portion of the at least one tubular passage and a second one of said at least two compartments surrounding a second portion of said walls defining an outlet portion of the at least one tubular passage.

2. Spinning apparatus according to claim 1, wherein the die assembly has at least two tubular passages through which the spinning solution is passed, each ones of the at least two tubular passages being defined by walls comprising at least one semipermeable membrane and/or at least one porous membrane, and in that the at least two tubular passages pass through each of said at least two compartments.

3. Spinning apparatus according to claim 2, wherein a plurality of said die assemblies are assembled together in a unit.

4. Spinning apparatus according to claim 1, wherein each one of said at least two compartments has supply and removal means for supplying fluent material to, and removing fluent material from, the each one of said at least two compartments in question.

5. Spinning apparatus according to of claim 1, wherein the cross-sectional area of said inlet portion of the at least one tubular passage increases towards said outlet portion.

6. Spinning apparatus according to claim 1, wherein the cross-sectional area of said inlet portion of the at least one tubular passage decreases towards said outlet portion.

7. Spinning apparatus according to claim 6, wherein the diameter of said inlet portion decreases substantially hyperbolically towards said outlet portion.

8. Spinning apparatus according to claim 1, wherein said walls of the at least one tubular passage are made of elastic, semipermeable or porous membrane material.

9. Spinning apparatus according to claim 1, wherein said walls of the at least one tubular passage are partly coated on their inner and/or outer surfaces with impermeable material to render said walls at least partly impermeable.

10. Spinning apparatus according to claim 1, wherein inner surfaces of said walls of the at least one tubular passage are coated with friction reducing material.

11. Spinning apparatus according to claim 1, wherein concentrically arranged feed means are positioned at the inlet end of the at least one tubular passage to supply said liquid spinning solution and one or more additional components to the at least one tubular passage.

12. Spinning apparatus according to claim 1 wherein said semipermeable membrane and/or porous membrane comprises cellulose acetate-based material, or substituted diethylaminoethyl, carboxl, or carboxymethyl groups.

13. Spinning apparatus according to claim 1, wherein said semipermeable membrane and/or porous membrane comprises a hollow-fibre membrane of polysulfone, polyethyleneoxide-polysulfone blends, silicone or polyacrylonitrile.

14. Spinning apparatus according to claim 1, comprising supply means for supplying cellulose acetate-based material, or substituted diethylaminoethyl, carboxyl, or carboxymethyl groups.

15. A method of forming spun material by passing liquid spinning solution through at least one tubular passage of a die assembly having at least partly permeable walls wherein the said walls of the at least one tubular passage comprise at least one semipermeable membrane and/or at least one porous membrane, wherein a first fluid material is supplied to a first compartment surrounding the at least one tubular passage for treating the liquid spinning solution, as it passes along the at least one tubular passage, and in that a second fluid material is supplied to a second compartment surrounding the at least one tubular passage for treating the liquid spinning solution as it passes along the at least one tubular passage by components permeating through the semipermeable or porous membrane(s) of said walls.

16. A method according to claim 15, wherein said first fluid material supplied to the first compartment is liquid or gaseous.

17. A method according to claim 15, wherein components of said first fluid material supplied to the first compartment pass through the semipermeable or porous walls of the tubular passage(s) to alter the pH, ionic composition, water content and/or small molecular weight composition of the liquid spinning solution passing through the at least one tubular passage.

18. A method according to claim 15, wherein the liquid spinning solution is treated by diffusion, dialysis, reverse dialysis, ultrafiltration, electro-osmosis, pre-evaporation or a combination of these as it passes through the at least one tubular passage.

19. A method according to claim 15, wherein the liquid spinning solution comprises a phase separating mixture and in that the liquid spinning solution is treated by diffusion of chemicals across the walls of the at least one tubular passage to regulate the phase separation and semipermeable polymerization process to produce filler particles or voids in the formed material.

20. A method according to claim 15, wherein the length, area and/or position or thickness of the walls of the at least one tubular passage are varied to influence the rate or extent or position at which the pH, ionic composition, or water content or small molecular weight composition are changed within the at least on passage.

21. A method according to claim 15, wherein draw down of the spinning solution to form the spun material commences within the at least one tubular passage.

22. A method according to claim 21, wherein the spun material subsequent to the draw down is treated or coated within the at least one tubular passage by components permearing through the semipermeable or porous membranes(s) of said walls.

23. A method according to claim 15 wherein said second fluid material supplied to the second compartment is liquid or gaseous.

24. A new method according to claim 15, wherein components of said second fluid material supplied to the second compartment pass through the semipermeable or porous walls of the at least one tubular passage to alter the pH, ionic composition, water content and/or small molecular spinning solution passing through the at least one tubular passage.

* * * * *

UNITED STATES PATENT AND TRADEMARK OFFICE

CERTIFICATE OF CORRECTION

PATENT NO. : 6,858,168 B1
DATED : March 10, 2005
INVENTOR(S) : Vollrath et al.

It is certified that error appears in the above-identified patent and that said Letters Patent is hereby corrected as shown below:

Column 4,
Line 18, “the composition the dope” should read -- the composition of the dope --;

Column 7,
Line 30, “optimise pinning” should read -- optimise spinning --;
Line 33, “filler articles or” should read -- filler particles or --;
Line 62, “providing reliable” should read -- providing a reliable --;

Column 14,
Line 20, “A new method” should read -- A method --;

Signed and Sealed this

Seventeenth Day of May, 2005

JON W. DUDAS
*Director of the United States Patent and Trademark Office*